United States Patent [19]

Kronich

[11] Patent Number: 4,977,863

[45] Date of Patent: Dec. 18, 1990

[54] AIR-COOLED INTERNAL COMBUSTION ENGINE HAVING CANTED COMBUSTION CHAMBER AND INTEGRAL CROSSOVER INTAKE MANIFOLD

[75] Inventor: Peter G. Kronich, Sheboygan, Wis.

[73] Assignee: Tecumseh Products Company, Tecumseh, Mich.

[21] Appl. No.: 415,895

[22] Filed: Oct. 2, 1989

[51] Int. Cl.[5] ..... F02F 1/06; F02F 1/30

[52] U.S. Cl. ..... 123/41.69; 123/65 VD; 123/90.23; 123/658; 123/179 SE; 123/195 HC

[58] Field of Search ..... 123/90.1, 90.23, 658, 123/65 VD, 179 SE, 52 M, 195 C, 195 P, 195 HC, 41.56, 41.69, 185 A, 185 B

[56] References Cited

U.S. PATENT DOCUMENTS

| | | | |
|---|---|---|---|
| 1,894,667 | 1/1933 | Church et al. | 123/658 |
| 2,003,677 | 6/1935 | Church | 123/658 |
| 3,118,433 | 1/1964 | Lechtenberg . | |
| 3,194,224 | 7/1965 | Lechtenberg et al. . | |
| 3,973,548 | 8/1976 | Celli | 123/195 C |
| 4,103,664 | 8/1978 | Iida et al. | 123/658 |
| 4,125,105 | 11/1978 | May | 123/658 |
| 4,380,216 | 4/1983 | Kandler | 123/90.65 |
| 4,494,490 | 1/1985 | Kiyooka et al. | 123/195 C |
| 4,548,167 | 10/1985 | Tamba et al. | 123/65 VD |
| 4,570,584 | 2/1986 | Uetsuji et al. | 123/179 SE |
| B14,570,584 | 3/1988 | Uetsuji et al. | 123/179 SE |
| 4,811,705 | 3/1989 | Ono et al. | 123/195 AC |

*Primary Examiner*—David A. Okonsky

*Attorney, Agent, or Firm*—Jeffers, Hoffman & Niewyk

[57] ABSTRACT

An air-cooled internal combustion engine, a crankshaft and a camshaft rotatably journalled in the crankcase parallel to one another, and a cast intake valve chamber and cast exhaust valve chamber each cast integrally with the cylinder and communicating with the combustion chamber via a respective intake valve port and exhaust valve port. Intake and exhaust valves are disposed for reciprocation in a direction lying perpendicular to the camshaft and simultaneously in a direction lying at an acute angle to a plane passing through the longitudinal axis of the cylinder and parallel to the axis of the camshaft. An intake cross-over manifold is cast integrally with the cylinder and is delimited by interior walls which are substantially straight in longitudinal direction from a fuel/air intake port to a point of intersection with the intake valve chamber.

27 Claims, 2 Drawing Sheets

AIR-COOLED INTERNAL COMBUSTION ENGINE HAVING CANTED COMBUSTION CHAMBER AND INTEGRAL CROSSOVER INTAKE MANIFOLD

BACKGROUND OF THE INVENTION

The present invention relates generally to internal combustion engines, and more particularly to an air-cooled engine having a so-called side-valve arrangement and a cross-over intake manifold.

At present, single-cylinder air-cooled engines with a side valve configuration have a crankshaft and camshaft which are parallel to one another, with the camshaft being gear driven by the crankshaft. The combustion chamber overlies the piston and adjacent side valves and the engine cylinder extends perpendicular to the crankshaft. The valves lie parallel to the cylinder and directly overlie the camshaft which they engage. One valve is located above a horizontal plane extending through the center line of the cylinder, and the other valve is located below the plane, but both valves are side-by-side on the same side of the engine.

With this engine geometry, the exhaust and intake ports are limited to a configuration in which the intake and exhaust ports are located on the valve side of the engine and directed away from the bore in planes perpendicular to the crankshaft, or else directed away from the bore in opposite directions in a common plane through the valve centers and parallel to the crankshaft. The latter configuration involves an upper inlet and downward discharge. With both the intake and exhaust ports on the same side of the engine, a separate manifold must be used on either the carburetor or muffler to separate these units, since the exhaust heat and space configuration will affect the function of the carburetor.

It is therefore advantageous to separate the intake and exhaust ports, preferably on opposite sides of the cylinder bore, which allows for direct port mount of the muffler to the block and does not limit the size of the muffler since no carburetor is mounted on the muffler side of the engine.

Usually when the aforementioned split configuration is used the carburetor is placed on the opposite side of the bore from the valves, with a separate intake manifold to cross over from the valve side of the engine. Another approach for a split configuration is to cross over with the exhaust below the bore from a down discharge configuration with a stamped steel exhaust manifold.

Because the cross-over manifold must traverse the perimeter of the cylinder, the cross-over passage must follow a curved route in order to get around the cylinder bore and connect to the valve. A curved passage is difficult to cast integrally with the engine block because a curved interior casting core usually cannot be removed non-destructively. Therefore, it is known to employ a tube-type cross-over manifold which is separately assembled to an elbow fitting to accomplish the necessary curved passageway.

It is also known to provide a curved cross-over intake manifold which is cast in place integrally with the engine block, but with an opening or window in a portion of the passageway to provide for removal of the casting core. The opening or window is closed by a separate cover which is assembled to the casting.

Another known approach for providing an integrally cast cross-over passageway involves providing a curved hollow metal tube as a casting core which remains in place in the casting. The ends of the tube are machined open subsequent to casting to provide the cross-over manifold.

It would be desireable to provide an improved engine arrangement in which the cross-over manifold is cast in its entirety integral with the engine block casting under conventional casting techniques involving removable and reusable casting cores.

The present invention provides this and other desireable advantages.

SUMMARY OF THE INVENTION

The present invention involves an air-cooled internal combustion engine of the side valve type, in which the location of the valve heads is rotated about the cylinder from the conventional position directly to the side of the cylinder so as to be disposed together on either side of a radius of the cylinder forming an acute angle with horizontal, yet with the camshaft remaining parallel to the crankshaft and the valves remaining in driven engagement with the camshaft and perpendicular thereto. This arrangement permits a cross-over manifold with straight interior walls to be cast integrally with the engine block and yet communicate directly with one of the valves without requiring a curved passageway.

In the present invention, according to a preferred embodiment thereof, a split configuration with the muffler on the valve side of the engine and the cross-over to the other side of the engine is accomplished with an integral diecast block without the addition of a separate manifold for cross over, and in addition places the exhaust portion of the cylinder and cylinder head in a more favorable configuration for cooling by exposing these areas to a direct cooling air stream from the flywheel cooling fan.

To achieve this configuration the combustion chamber in an "L-head" side valve arrangement is canted at about 35° or thereabout, depending on the actual bore diameter, from the bore horizontal. This raises the intake valve above the bore diameter to allow an intake passage to be cast integrally with the block, without any separate cover or separate cross-over tube. The crack and cam shaft remain parallel in the same attitude as in a conventional side valve configuration, but the camshaft is lengthened and the cam lobes are shifted upward toward the engine flywheel due to the shift of the intake and exhaust as the combustion chamber is canted. Since the valves operate in planes perpendicular to the camshaft, the valve cant differs due to the distance from the cam center line with a lesser cant on the exhaust valve than on the intake valve. The motion of the valves and valve lift remains the same as with a conventional side valve engine. Because of the cant of the valves with respect to the combustion chamber, an advantage may result from a pre-combustion swirl of the intake gases and scavenging of the exhaust gases favoring the flow direction of the inlet charge and exhaust during valve overlap.

The arrangement of the present invention eliminates the necessity of a separate tube-like cross-over manifold as in the prior art, and permits casting of the cross-over manifold with the engine block in one operation, without further assembly steps or exotic casting techniques.

The valves remain perpendicular to the camshaft to preserve the simple efficiency of such an arrangement, yet the valves are inclined relative to a plane passing through the center line of the cylinder so as to maintain the valve heads in a spaced relationship with respect to one another and to the cylinder similar to that enjoyed in the prior art. The combustion chamber is therefore substantially shaped as the prior art combustion chamber, but is canted in orientation with respect to horizontal.

A horizontal offset between the valves is one result of the present invention, which allows for better cooling of the valves since the valves are no longer aligned in the direction of cooling air flow, which flows downwardly in a vertical shaft engine.

The invention, in one form thereof, provides an air-cooled internal combustion engine having a cast crankcase, a cast cylinder extending from the crankcase, a crankshaft rotatably journalled in the crankcase, and a piston disposed for reciprocation in the cylinder and drivingly connected with the crankshaft, the cylinder having a combustion chamber disposed above the piston. A camshaft is journalled for rotation in the crankcase parallel to the crankshaft and is drivingly connected with the crankshaft. A cast intake valve chamber and a cast exhaust valve chamber are each cast integrally with the cylinder and communicate with the combustion chamber via a respective intake valve port and exhaust valve port. The intake and exhaust valve ports are each periodically occluded by a respective intake and exhaust valve drivingly connected with the camshaft for reciprocal motion in response to rotation of the camshaft. A fuel/air intake port is disposed to one side of the cylinder for connection to a carburetor, and an exhaust port is disposed to the other side of the cylinder for connection to a muffler. An elongate intake cross-over manifold is cast integrally with the cylinder and communicates the fuel/air intake port with the intake valve chamber, the intake cross-over manifold including an interior passageway delimited by interior walls which are substantially straight in longitudinal direction from the fuel/air intake port to a point of intersection with the intake valve chamber, whereby a casting core defining the interior walls of the intake cross-over manifold during casting of the cylinder can be non-destructively withdrawn subsequent to casting.

The invention, according to another aspect thereof, provides an air-cooled internal combustion engine having a crankcase. A cylinder extends from the crankcase and has a longitudinal axis. A crankshaft is rotatably journalled in the crankcase, and a piston is disposed for reciprocation in the cylinder and is drivingly connected with the crankshaft. The cylinder has a combustion chamber disposed above the piston, and a single camshaft is journalled for rotation in the crankcase parallel to the crankshaft and is drivingly connected with the crankshaft. A cast intake valve chamber and a cast exhaust valve chamber are each cast integrally with the cylinder and communicate with the combustion chamber via a respective intake valve port and exhaust valve port. The intake and exhaust valve ports are each periodically occluded by a respective intake and exhaust valve engaging the camshaft for reciprocal motion thereof in response to rotation of the camshaft. At least one of the intake and exhaust valves is disposed for reciprocation in a direction lying perpendicular to the camshaft and simultaneously in a direction lying at an acute angle to a plane passing through the longitudinal axis of the cylinder and parallel to the axis of the camshaft.

It is an object of the present invention to provide an improved valve arrangement for a side-valve type engine to permit a cross-over manifold communicating with one of the valves to be cast integrally with the cylinder casting.

Further objects and advantages of the present invention will be apparent from the following descriptions.

DESCRIPTION OF THE PREFERRED EMBODIMENT

Figure 1:
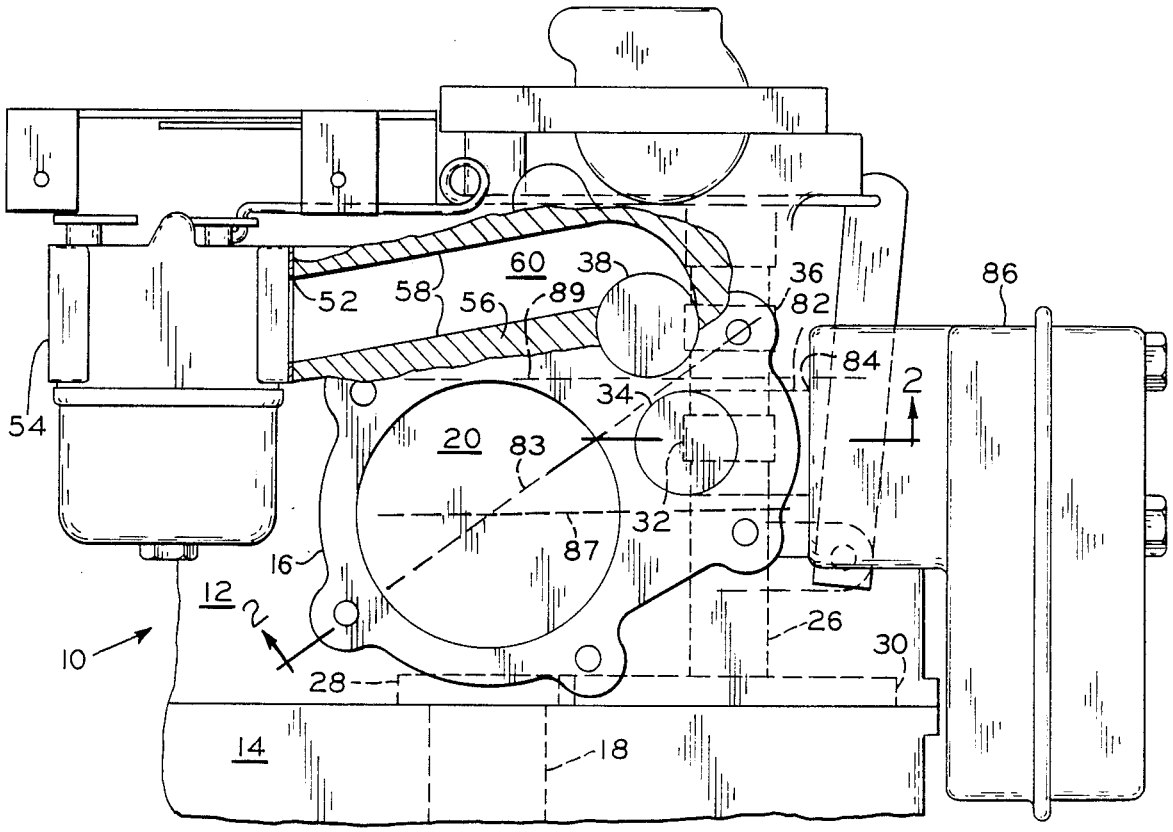
FIG. 1 is an elevational, partially cut-away view of an air-cooled internal combustion engine in accordance with the present invention, particularly showing an end view of the cylinder with the cylinder head removed and also showing the integral crossover intake manifold.

Referring to FIG. 1, there is illustrated an internal combustion engine 10 of the type having a vertical crankshaft and a parallel vertical camshaft, a horizontal cylinder, and a so-called side valve arrangement wherein the valves are disposed to one side of the cylinder bore and reciprocate within the cylinder casting and extend into the crankcase where they engage the camshaft.

More specifically, engine 10 includes crankcase 12, including an oil sump 14, and a cylinder 16 extending horizontally from crankcase 12. Vertical crankshaft 18 is journalled in crankcase 12 for rotation therein in the conventional manner, and piston 20 is drivingly connected to crankshaft 18 via a conventional wrist pin 22 and connecting rod 24 (see FIG. 2). Vertical camshaft 26 is journalled for rotation in crankcase 12 parallel to crankshaft 18 and is spaced therefrom. Drive gear 28 of crankshaft 18 engages and drives driven gear 30 which is connected to camshaft 26. Gears 28 and 30 are in constant mesh and thereby maintain appropriate valve timing of the camshaft relative to the crankshaft. Camshaft 26 includes eccentric exhaust valve lifter lobe 32 for causing reciprocal motion of exhaust valve 34 upon rotation of camshaft 26, and eccentric intake valve lifter lobe 36 for causing reciprocal motion of intake valve 38 upon rotation of camshaft 26.

Figure 2:
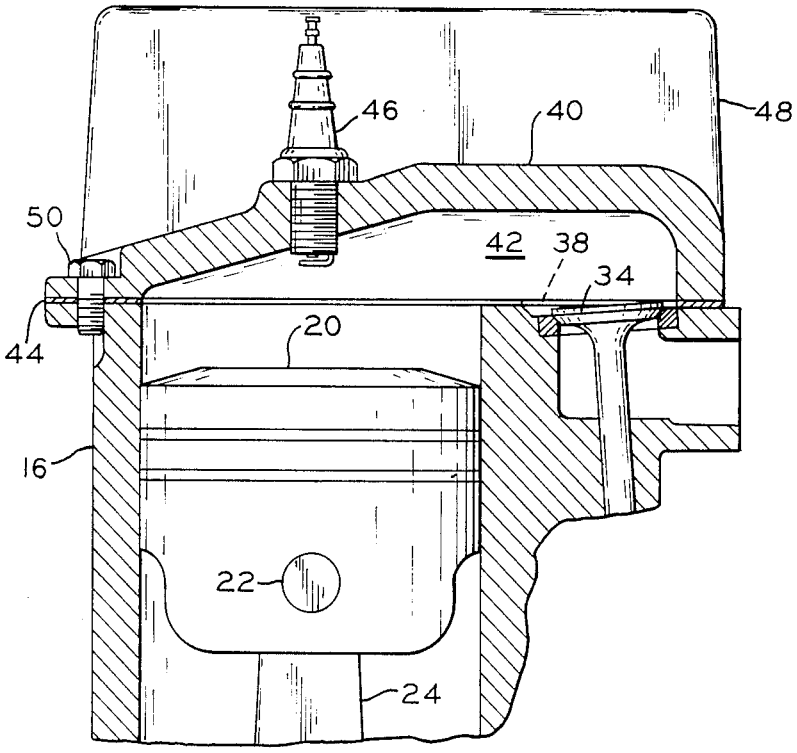
FIG. 2 is a sectional view of the engine of FIG. 1 taken along section line 2—2 and viewed in the direction of the arrows.

Referring to FIG. 2, in particular, cylinder 16 is closed on the top end thereof by cylinder head 40 which overlies piston 20 and adjacent valves 34 and 38, forming a combustion chamber 42. Gasket 44 compressed between cylinder head 40 and cylinder 16 provides sealing against the escape of combustion gases. A spark plug 46 is received in a threaded hole in cylinder head 40 in convention fashion and is connected to conventional electrical ignition means. Cooling fin 48 is one of a plurality of cooling fins integrally cast with cylinder head 40 for dissipating heat of combustion. A plurality of bolts 50 secure cylinder head 40 to cylinder 16.

Again referring to FIG. 1, there is disposed to one side of cylinder 16 an air/fuel intake port 52 to which is attached carburetor 54 which serves to deliver an appropriate air/fuel mixture thereto. Cast integrally with cylinder 16 is a cross-over intake manifold 56 having interior walls 58 which delimit an interior passageway 60.

Figure 3:
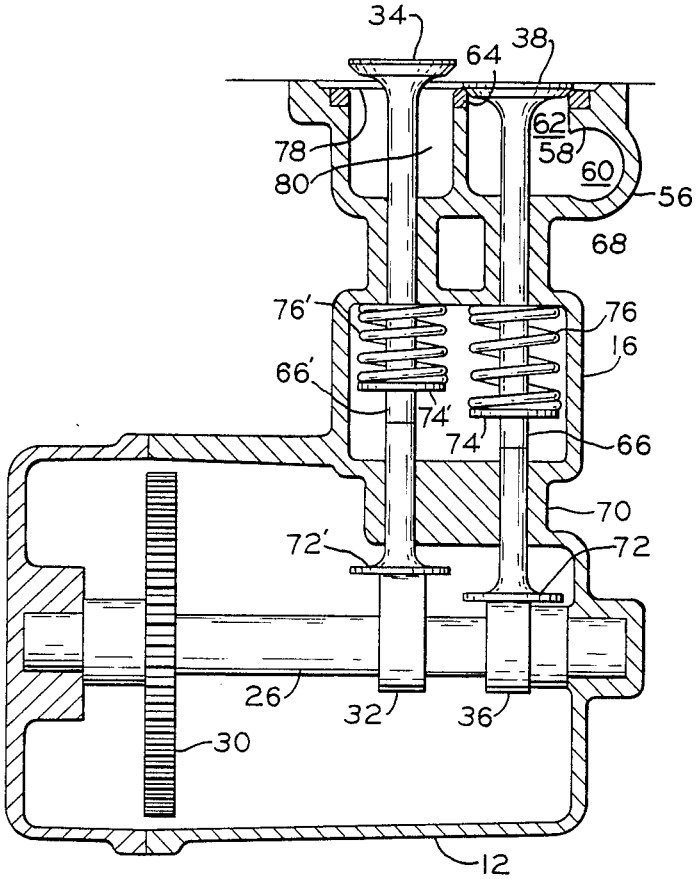
FIG. 3 is a sectional view of the engine of FIG. 1, particularly showing the intake and exhaust valves viewed in a direction perpendicular to the camshaft.

Referring particularly to FIG. 3, interior passageway 60 of cross-over manifold 56 is shown at the point where it intersects with intake valve chamber 62, thereby providing communication from fuel/air intake port 52 to combustion chamber 42 via intake valve port 64. Intake valve 38 includes a valve stem 66 slidingly received in bearing portions 68 and 70 of cylinder casting 16. Valve lifter portion 72 of valve stem 66 engages cam lobe 36 of camshaft 26. An annular flange 74 on valve stem 66 carries a compression helical spring 76 which surrounds valve stem 66 and bears against cylinder casting 16 so as to bias valve 38 downwardly into a closed condition. Compression spring 76 is overcome by the lifting action of cam lobe 36 as camshaft 26 rotates, resulting in a reciprocal motion of intake valve 38 which periodically occludes intake valve port 64. Exhaust valve 34 similarly includes a valve stem 66', valve lifter portion 72', annular flange 74', and helical compression spring 76'. Likewise, cam lobe 32 provides a lifting action as camshaft 26 rotates, resulting in a reciprocal motion of exhaust valve 34 which periodically occludes exhaust valve port 78 of exhaust valve chamber 80. Combustion chamber 42 communicates with exhaust valve chamber 80 via exhaust valve port 78, and exhaust valve chamber 80 in turn communicates with exhaust manifold 82 which leads to exhaust port 84 and muffler 86 (see FIG. 1). Intake port 52 and exhaust port 84 are disposed on opposite sides of cylinder 16 to provide separation of carburetor 54 and muffler 86 to prevent undesirable thermal interaction therebetween.

Figure 4:
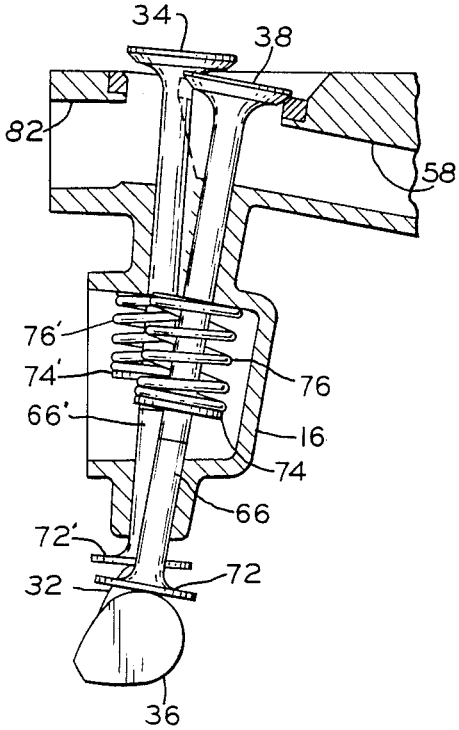
FIG. 4 is a sectional view of the engine of FIG. 1, particularly showing the intake and exhaust valves viewed in a direction parallel to the camshaft.

Referring to FIG. 4, it can be seen that intake valve 38 and exhaust valve 34 are each disposed at an acute angle with respect to a plane passing through the longitudinal axis of the cylinder, with intake valve 38 being disposed at a relatively greater angle than exhaust valve 34. In particular, intake valve 38 is canted at an angle in the range of about 8° to about 15°, preferably about 10°, whereas exhaust valve 34 is canted at an angle in the range of about 3° to about 7°, preferably about 4°. The reason for the particular canted arrangement of the valves is best made clear in comparison with the arrangement of the prior art, as will be explained hereafter.

In a conventional side valve type engine having a vertical crankshaft, the cylinder is disposed horizontally and the valves are likewise disposed horizontally parallel to the cylinder on one side of the cylinder so that the valves are located vertically one above the other. Typically, one valve would be located above a horizontal plane passing through the axis of the cylinder, and the other valve would be located below that same plane. With such an arrangement, the two valves would be located side-by-side on one side of the engine which would most naturally lead to placement of the carburetor and muffler on the same side of the engine next to each respective valve. Such an arrangement is not satisfactory, however, due to deleterious thermal interaction between the hot muffler and the carburetor. Consequently, it is conventional to locate the carburetor on the side of the engine opposite the valves and provide a relatively long cross-over intake manifold to connect the carburetor to the intake valve. The cross-over manifold generally includes a horizontal run which must be elevated high enough to clear the engine cylinder, and then must include a curved run which traverses a portion of the periphery of the cylinder to reach the intake valve. The curved nature of the intake manifold precludes its being cast integrally with the engine cylinder by straightforward conventional casting means since it is impossible or difficult at best to remove a curved casting core non-destructively. Consequently, the prior art solution has been either to make the cross-over manifold of a separate tube which is assembled to the casting, or to provide a cast curved passageway with a window in the outside bend of the passageway to permit removal of the core. The window is later occluded by a separated cover assembled to the casting.

The embodiment of the present invention can be envisioned as a conventional side valve type arrangement in which the locations of the valve heads have been maintained approximately the same relative to each other, but have been rotated about the cylinder such that a radius or plane 83 drawn from the center line of the cylinder between the two valves no longer lies horizontally, but rather lies at an angle in the range of about 30° to about 45° above a horizontal plan 87, with an angle of about 35° being preferred. By this aforementioned rotation, the upper valve obtains a new location sufficiently elevated that it can be intersected by a cross-over manifold which clears the cylinder without having to be curved. The intake valve chamber lies at least in part on one side of a plane 89 tangent to the piston bore of the cylinder and perpendicular to the crankshaft, while the exhaust valve chamber lies at least in part on the other side of that plane 89. Thus, the cross-over manifold can be cast integrally with the cylinder casting using a straight casting core and intersect the intake valve chamber without intersecting the piston bore.

In order to retain a vertical camshaft which remains directly driven by the vertical crankshaft, and to maintain the valves perpendicular to the camshaft to retain conventional lifting action by the cams, the cam lobes have merely been shifted vertically along the camshaft so that each cam lobe is aligned in the horizontal direction with its respective valve. Thus, as shown in FIG. 3, the valves operate perpendicular the camshaft as before.

Rotating the valve head locations about the cylinder preserves the relative position of the valve heads to one another and also maintains the relative position of the valve heads to the cylinder, so that the shape of the combustion chamber is not unduly modified, but is merely shifted in orientation with respect to the horizontal. This, however, requires that the valves themselves be canted with respect to a vertical plane along the centerline of the cylinder, since the horizontal distance from the camshaft to the new location of the valve heads in the combustion chamber is now greater than in the prior art. In the prior art, the horizontal distance was zero. Inasmuch as the displacement of position of the upper (intake) valve is greater than that of the lower (exhaust) valve, the angular 25 inclination of the upper valve is likewise greater (10° vs. 4°). To preserve the same lift and valve lengths, the cam lobes are the same as in the prior art, and the valve seat of the more highly inclined valve (intake) is relatively lower than the valve seat of the lesser inclined valve (exhaust).

A further advantageous result of the valve arrangement shown herein is that the valve heads are offset from one another in the horizontal direction. In the prior art, the valves were located vertically above one another, with the result that cooling air which was directed vertically downward from the flywheel blower by the air shroud impinged upon the upper intake valve which then somewhat blocked the impingement of cooling air on the exhaust valve located directly below in the direction of air flow. In the present arrangement, the horizontal offset of the valve heads permits more direct impingement of cooling air on the lower exhaust valve, providing better cooling thereof.

Figure 5:
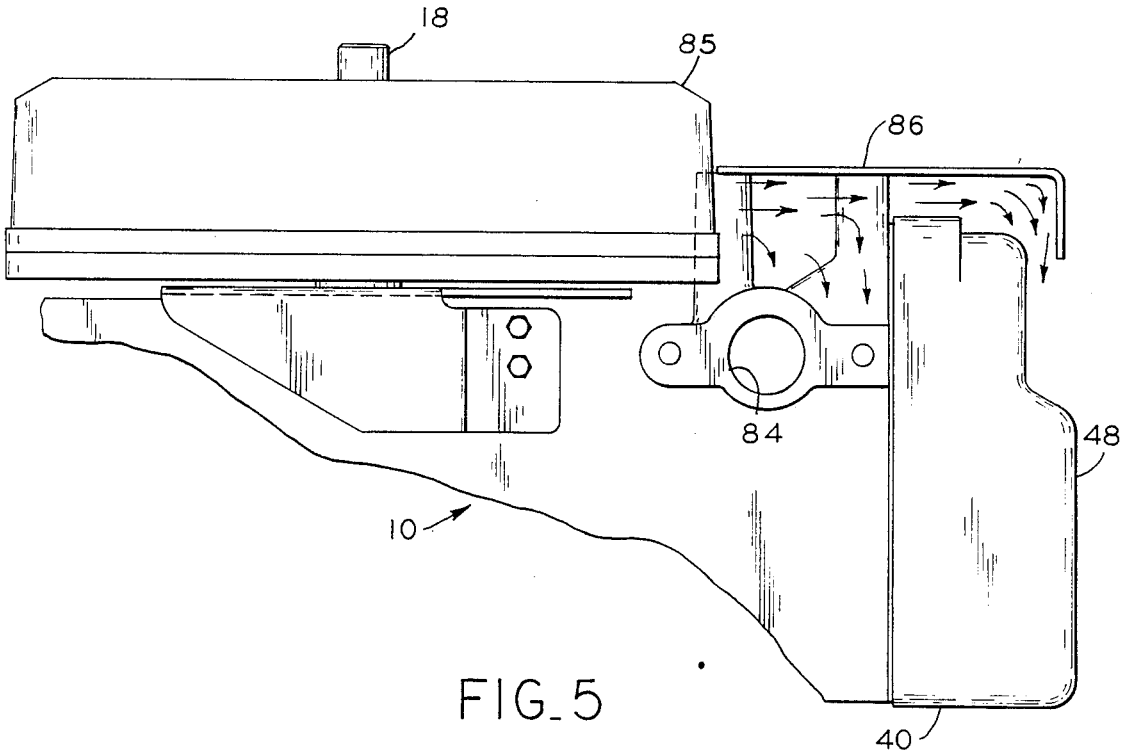
FIG. 5 is a partial elevational view of the engine of FIG. 1, particularly showing the flow of air from the flywheel blower over the cylinder head.

With reference to FIG. 5, there is illustrated a view of the engine 10 including flywheel blower 85 and air shroud 86 which directs air (indicated by arrows) downwardly over the valve chambers and the cylinder head 40, with cooling fins 48.

While the present invention has been particularly described in the context of a preferred embodiment, it will be understood that the invention is not limited thereby. Therefore, it is intended that the scope of the invention include any variations, uses or adaptations of the invention following the general principles thereof and including such departures from the disclosed embodiment as come within known or customary practice in the art to which the invention pertains and which fall within the appended claims or the equivalents thereof.

What is claimed is:

1. In an air-cooled internal combustion engine having a crankcase, a cast cylinder block extending from the crankcase, a crankshaft rotatably journalled in the crankcase, a piston disposed for reciprocation in a bore in the cylinder block and drivingly connected with the crankshaft, a combustion chamber disposed adjacent an end of said cylinder block, a camshaft journalled for rotation in the crankcase and drivingly connected with the crankshaft, a cast intake valve chamber and a cast exhaust valve chamber each cast integrally with the cylinder block and communicating with the combustion chamber via a respective intake valve port and exhaust valve port, the intake and exhaust valve ports each being periodically occluded by a respective intake and exhaust valve drivingly connected with the camshaft for reciprocal motion in response to rotation of the camshaft, a fuel/air intake port disposed on an outer face of said cylinder block to one side of the cylinder block for connection to a carburetor, and an exhaust port disposed on an opposite outer face of the cylinder block for connection to a muffler, the improvement comprising:

an elongate intake cross-over passage cast integrally with the cylinder block and communicating the fuel/air intake port with the intake valve chamber, said intake cross-over passage including an interior passageway delimited by interior walls which are substantially straight in longitudinal direction from the fuel/air intake port to a point of intersection with the intake valve chamber, whereby a casting core defining the interior walls of the intake cross-over passage during casting of the cylinder block can be non-destructively withdrawn subsequent to casting.

2. The engine of claim 1, in which the crankshaft is vertical and the cylinder bore is horizontal.

3. The engine of claim 1, in which a plane drawn including the central axis of the cylinder and passing between the two valve chambers lies at an angle in the range of about 30° to about 45° with respect to a plane perpendicular to the camshaft axis.

4. The engine of claim 2, in which a plane drawn including the central axis of the cylinder and passing between the two valve chambers lies at an angle of about 35° with respect to a plane perpendicular to the camshaft axis.

5. In an air-cooled internal combustion engine having a crankcase, a cylinder block extending from the crankcase and having a longitudinal axis, a crankshaft rotatably journalled in the crankcase, a piston disposed for reciprocation in a bore in the cylinder block and drivingly connected with the crankshaft, the engine having a combustion chamber disposed above the piston, a single camshaft journalled for rotation in the crankcase and drivingly connected with the crankshaft, a cast intake valve chamber and a cast exhaust valve chamber each cast integrally with the cylinder block and communicating with the combustion chamber via a respective intake valve port and exhaust vale port, the intake and exhaust valve ports each being periodically occluded by a respective intake and exhaust valve engaging the camshaft for reciprocal motion thereof in response to rotation of the camshaft, a fuel/air intake port in one side of said cylinder block for connection to a carburetor, an exhaust gas port in an opposite side of said cylinder block for connection to a muffler, the improvement comprising:

at least one of the intake and exhaust valves being disposed for reciprocation in a direction lying perpendicular to the camshaft and at an acute angle to a plane including the longitudinal axis of the cylinder and parallel to the axis of the camshaft, and an intake passage cast integrally with said cylinder block extending through said cylinder block and connecting said fuel/air intake port with the intake valve port.

6. The engine of claim 5, in which the crankshaft is vertical and the cylinder bore is horizontal.

7. The engine of claim 6, in which a plane drawn including the central axis of the cylinder and passing between the two valve chambers lies at an angle of about 35° above a horizontal plane.

8. The engine of claim 5, in which each of the intake and exhaust valves includes a valve head, and further including means driven by the crankshaft for causing cooling air to flow over exterior surfaces of the engine in a direction parallel to the crankshaft, the valve heads of the valves being offset from one another in a direction perpendicular to the direction of cooling air flow.

9. The engine of claim 5, in which each of the intake and exhaust valves is disposed for reciprocation in a direction lying perpendicular to the camshaft and simultaneously in a direction lying at an acute angle to a plane including the longitudinal axis of the cylinder bore and parallel to the axis of the camshaft.

10. The engine of claim 9, in which each of the intake and exhaust valve includes a valve head, and further including means driven by the crankshaft for causing cooling air to flow over exterior surfaces of the engine in a direction parallel to the crankshaft, the valve heads of the valves being offset from one another in a direction perpendicular to the direction of cooling air flow.

11. The engine of claim 9, in which one of the intake and exhaust valves lies at an acute angle greater than the acute angle at which the other of the intake and exhaust valves lies.

12. The engine of claim 11, in which the intake valve lies at an acute angel in the range of about 8° to about 15°, and the exhaust valve lies at an acute angle in the range of about 3° to about 7°.

13. The engine of claim 11, in which the intake valve lies at an acute angle of about 10°, and the exhaust valve lies at an acute angle of about 4°.

14. The engine of claim 5, wherein said intake cross-over passage includes an interior passageway delimited by interior walls which are substantially straight in longitudinal direction from the fuel/air intake port to a point of intersection with the intake valve chamber, whereby a casting core defining the interior walls of the intake cross-over passage during casting of the cylinder block can be non-destructively withdrawn subsequent to casting.

15. The engine of claim 14, in which each of the intake and exhaust valves includes a vale head, and further including means driven by the crankshaft for causing cooling air to flow over exterior surfaces of the engine in a direction parallel to the crankshaft, the valve heads of the valves being offset from one another in a direction perpendicular to the direction of cooling air flow.

16. The engine of claim 14, in which each of the intake and exhaust valves is disposed for reciprocation in a direction lying perpendicular to the camshaft and simultaneously in a direction lying at an acute angle to a plane including the longitudinal axis of the cylinder bore and parallel to the axis of the camshaft.

17. The engine of claim 16, in which each of the intake and exhaust valves includes a valve head, and further including means driven by the crankshaft for causing cooling air to flow over exterior surfaces of the engine in a direction parallel to the crankshaft, the valve heads of the valves being offset from one another in a direction perpendicular to the direction of cooling air flow.

18. The engine of claim 16, in which one of the intake and exhaust valves lies at an acute angle greater than the acute. angle at which the other of the intake and exhaust value lies.

19. The engine of claim 18, in which the intake valve lies at an acute angle of about 10°, and the exhaust valve lies at an acute angle of about 4°.

20. In an air-cooled internal combustion engine having a crankcase, a cast cylinder block having a piston bore and extending from the crankcase, a crankshaft rotatably journalled in the crankcase, a piston disposed for reciprocation in the piston bore of the cylinder and drivingly connected with the crankshaft, the engine having a combustion chamber disposed above the piston, a camshaft journalled for rotation in the crankcase and drivingly connected with the crankshaft, a cast intake valve chamber and a cast exhaust vale chamber each cast integrally with the cylinder block and communicating with the combustion chamber via a respective intake valve port and exhaust valve port, the intake and exhaust valve ports each being periodically occluded by a respective intake and exhaust valve drivingly connected with the camshaft for reciprocal motion in response to rotation of the camshaft, a fuel/air intake port disposed to tone side of the cylinder block for connection to a carburetor, and an exhaust port disposed to an opposite side of the cylinder block for connection to a muffler, the improvement comprising:

an elongate intake cross-over manifold cast integrally with the cylinder block and communicating the fuel/air intake port with the intake valve chamber, the intake valve chamber lying at least in part on one side of a plane tangent to the piston bore of said cylinder block and perpendicular tot he crankshaft, the exhaust valve chamber lying at least in part on the other side of said plane.

21. The engine of claim 20, in which a plane drawn including the central axis of the cylinder and passing between the two valve chambers lies at an angle in the range of about 30° to about 45° with respect to a plane perpendicular to the camshaft axis.

22. The engine of claim 20, in which the crankshaft is vertical and the cylinder bore is horizontal.

23. The engine of claim 22, in which a plane drawn including the central axis of the cylinder and passing between the two valve chambers lies at an angle of about 35° with respect to a plane perpendicular to the camshaft axis.

24. The engine of claim 21, in which each of the intake and exhaust valves are disposed for reciprocation in a direction lying perpendicular to the camshaft and simultaneously in a direction lying at an acute angle to a plane passing through the longitudinal axis of the cylinder and parallel to the axis of the camshaft.

25. The engine of claim 24, in which each of the intake and exhaust valves includes a valve head, and further including means driven by the crankshaft for causing cooling air to flow over exterior surfaces of the engine in a direction parallel to the crankshaft, the valve heads of the valves being offset from one another in a direction perpendicular to the direction of cooling air flow.

26. The engine of claim 24, in which the intake valve lies at an acute angle in the range of about 8° to about 15°, and the exhaust valve lies at an acute angle in the range of about 3° to about 7°.

27. In an air-cooled L-head internal combustion engine having a crankcase, a cast cylinder block extending from the crankcase, a head mounted to the crankcase, a crankshaft rotatably journalled in the crankcase, a piston disposed for reciprocation in the cylinder block and drivingly connected with the crankshaft, the head having a combustion chamber disposed adjacent an end of said cylinder block, a camshaft journalled for rotation in the crankcase and drivingly connected with the crankshaft, a cast intake valve chamber and a cast exhaust valve chamber each cast integrally with the cylinder block and communicating with the combustion chamber iva a respective intake valve port and exhaust valve port, the intake and exhaust valve ports each being periodically occluded by a respective intake and exhaust valve drivingly connected with the camshaft for reciprocal motion in response to rotation of the camshaft, a fuel/air intake port disposed on an outer face of said cylinder block for connection to a carburetor, and an exhaust port disposed on an opposite outer face of the cylinder block for connection to a muffler, the improvement comprising:

an elongate intake cross-over manifold cast integrally with the cylinder block and communicating the fuel/air intake port with the intake valve chamber, said intake cross-over manifold including an interior passageway delimited by interior walls which are substantially straight in longitudinal direction from the fuel/air intake port to a point of intersection with the intake valve chamber, whereby a casting core defining the interior walls of the intake cross-over manifold during casting of the cylinder block can be non-destructively withdrawn subsequent to casting.

* * * * *

UNITED STATES PATENT AND TRADEMARK OFFICE

CERTIFICATE OF CORRECTION

PATENT NO. : 4,977,863

DATED : December 18, 1990

INVENTOR(S) : Peter G. Kronich

It is certified that error appears in the above-identified patent and that said Letters Patent is hereby corrected as shown below:

Claim 10, column 8, line 59, after "exhaust" delete "valve" and substitute therefor --valves--.

Claim 12, column 9, line 2, delete "angel" and substitute therefor --angle--.

Claim 15, column 9, line 17, delete "vale" and substitute therefor --valve--.

Claim 18, column 9, line 41. delete "value" and substitute therefor --valves--.

Claim 20, column 9, line 53, delete "vale" and substitute therefor --valve--.

Claim 20, column 9, line 61, delete "tone" and substitute therefor --one--.

Claim 20, column 10, line 2, delete "tot he" and substitute therefor --to the--.

Claim 27, column 10, line 46, delete "iva" and substitute therefor --via--.

Signed and Sealed this

Twenty-third Day of June, 1992

*Attest:*

DOUGLAS B. COMER

*Attesting Officer*

*Acting Commissioner of Patents and Trademarks*